US012054990B2

(12) United States Patent
Bruandet et al.

(10) Patent No.: US 12,054,990 B2
(45) Date of Patent: Aug. 6, 2024

(54) ROCK DRILL BIT FOR PERCUSSIVE DRILLING

(71) Applicants: SANDVIK MINING AND CONSTRUCTION OY, Tampere (FI); SANDVIK MINING AND CONSTRUCTION TOOLS AB, Sandviken (SE)

(72) Inventors: Olivier Bruandet, Tampere (FI); Mathias Hareland, Tampere (FI); Gustav Gewers, Tampere (FI)

(73) Assignee: Sandvik Mining and Construction AB, Tampere (FI)

( * ) Notice: Subject to any disclaimer, the term of this patent is extended or adjusted under 35 U.S.C. 154(b) by 199 days.

(21) Appl. No.: 17/414,773

(22) PCT Filed: Nov. 27, 2019

(86) PCT No.: PCT/EP2019/082648

§ 371 (c)(1),
(2) Date: Jun. 16, 2021

(87) PCT Pub. No.: WO2020/126358

PCT Pub. Date: Jun. 25, 2020

(65) Prior Publication Data

US 2022/0065047 A1 Mar. 3, 2022

(30) Foreign Application Priority Data

Dec. 17, 2018 (EP) ..... 18212828

(51) Int. Cl.
*E21B 4/14* (2006.01)
*E21B 10/38* (2006.01)

(52) U.S. Cl.
CPC ..... *E21B 10/38* (2013.01); *E21B 4/14* (2013.01)

(58) Field of Classification Search
None
See application file for complete search history.

(56) References Cited

U.S. PATENT DOCUMENTS 1,868,400 A * 7/1932 Stover ..... E21B 21/12 175/320
3,346,060 A 10/1967 Beyer
(Continued)

FOREIGN PATENT DOCUMENTS

CL 202002727 10/2020
CN 1826454 A 8/2006
(Continued)

*Primary Examiner* — Kipp C Wallace
(74) *Attorney, Agent, or Firm* — Corinne R. Gorski

(57) ABSTRACT

The present disclosure relates to a rock drill bit for a percussive drilling hammer positioned at the cutting end of a hammer. The drill bit includes a head, an elongated shank connected to the head at a front end of the bit, a head-shank transition area where the head connects to the shank, an anvil at the rear end of the shank for receiving the impact of the piston, a plurality of buttons provided at the front face of the head configured to engage the material to be crushed in the intended direction of drilling, and a plurality of flushing passages extending through the head and having at least one opening at the front face of the head. An angle formed between the head and the shank at the head-shank transition area is greater than 100 degrees.

11 Claims, 7 Drawing Sheets

(56) References Cited

U.S. PATENT DOCUMENTS 4,051,912 A 10/1977 White
4,280,570 A * 7/1981 Walter ..... E21B 4/14 173/78
4,295,761 A 10/1981 Hansen
4,705,118 A * 11/1987 Ennis ..... E21B 6/06 175/65
4,716,976 A 1/1988 Isakov
5,407,021 A * 4/1995 Kane ..... E21B 10/38 175/418
5,839,525 A * 11/1998 Hoffmaster ..... E21B 7/064 76/108.4
6,789,632 B2 9/2004 Green
7,581,602 B2 * 9/2009 Lorger ..... E21B 4/14 175/418
8,915,314 B2 * 12/2014 Lyon ..... E21B 4/14 175/135
9,938,768 B2 * 4/2018 Carlsson ..... E21B 17/22
2002/0066599 A1 * 6/2002 Gien ..... E21B 4/14 175/405
2006/0283637 A1 * 12/2006 Viel ..... E21B 10/02 175/403
2010/0243333 A1 * 9/2010 Purcell ..... E21B 4/14 175/414
2014/0360783 A1 * 12/2014 Lyon ..... E21B 4/14 175/57
2016/0340983 A1 * 11/2016 Bruandet ..... E21B 4/14
2020/0370373 A1 * 11/2020 Aros ..... E21B 10/38

FOREIGN PATENT DOCUMENTS

CN 105113978 A 12/2015
CN 205089211 U 3/2016
CN 205135678 U 4/2016
KR 102102358 B1 4/2020
WO 2012126042 A1 6/2018
WO 2018107304 A1 6/2018

* cited by examiner

ROCK DRILL BIT FOR PERCUSSIVE DRILLING

RELATED APPLICATION DATA

This application is a § 371 National Stage Application of PCT International Application No. PCT/EP2019/082648 filed Nov. 27, 2019 claiming priority to EP 18212828.0 filed Dec. 17, 2018.

TECHNICAL FIELD

The present disclosure relates to a rock drill bit used in a percussive down-the-hole drilling assembly. More particularly, the present disclosure relates to the rock drill bit which is designed to have a longer life-span due to reduced stresses in the bit head-shank transition area.

BACKGROUND

Down-the-hole (DTH) percussive drilling involves a method combining percussions and rotations. A pressurized fluid is supplied via a drilling tube to a drill bit located at the bottom of a bore hole. This fluid acts to both drive the hammer drilling action and to flush rearwardly the broken debris resulting from the cutting action. Typically, a DTH percussive drilling assembly or a hammer drill bit assembly comprises a casing extending between a top sub and a drill bit that is releasably coupled to a drive sub. A reciprocating fluid driven impact device or piston is arranged inside the casing. At both ends of the piston are working chambers, namely a top working chamber and a bottom working chamber into which fluid is discharged according to the work cycle of the piston. Conventional DTH drilling machine also comprises a drill bit assembly made up of a shank, a bit head which further comprises buttons on the surface facing the drill hole, and flushing holes to allow broken debris to be removed immediately so that the buttons hit fresh solid rock surface with each impact. Usually, the angle between the shank and the bit head, known also as the bit head-shank transition angle is 90 degrees. In general, the bit head-shank transition area undergoes stress during the drilling operation. But especially for the drill bits where the central bore is blind or closed at the axially forward end, the stress in the bit head-shank transition area increases because the flushing holes usually intersect the transition area creating a stress concentration zone. Examples of conventional percussive drill bits are disclosed in U.S. Pat. Nos. 3,346,060, 4,051,912, 4,716,976 and 6,789,632. Because of the location of flushing holes in the blind-bore bits, during impact stress wave energies are generated in the head-shank transition area, leading to early bit failure. The reduced life span of the drill bit owing to the stress exerted on the head-shank transition area is a major drawback of the commonly used blind-bore drill bit assemblies in DTH hammers.

Accordingly, there exists a need for a robust, compact and structurally uncomplicated drill bit which addresses the problem of reduced lifespan of the drill bit because of high stresses on the bit shank-head transition area, and also exhibits good drilling efficiency.

BRIEF SUMMARY OF THE DISCLOSURE

The aim of the present disclosure is to overcome or at least reduce the above-mentioned problems.

It is an objective of the present disclosure to provide a robust rock drill bit with an increased life span. It is a further objective of the present disclosure to provide a rock drill bit which is adapted to withstand high stresses, especially those which occur in the bit-head transition area. It is yet another objective of the present disclosure to provide a rock drill bit which utilizes the bit body as the bottom working chamber of the down-the-hole hammer. Still another objective of the present disclosure is to provide a substantially simplified yet highly efficient percussion drilling tool.

The objectives are achieved by providing a rock drill bit specifically configured to withstand high stress wave energies generating during the drilling operation especially in the bit head-shank transition area. According to the first embodiment of the present disclosure, there is provided a rock drill bit for a percussive drilling hammer positioned at the cutting end of the hammer, and comprising of a head, an elongated shank connected to the head at the front end or the axially forward end of the shank, a head-shank transition area where the head connects to the shank, an anvil at the axially rearward end of the shank for receiving the impact of the piston, a plurality of buttons provided at the front face of the head configured to engage the material to be crushed in the intended direction of drilling and a plurality of flushing passages for the fluid extending through the head and having at least one opening at the front face of the head. The rock drill bit solves the above-mentioned problem of increased stress on the bit head-shank transition area by the characterizing feature that the angle formed between the head and the shank at the head-shank transition area is greater than 100 degrees. Preferably, the angle may be between 100 and 160 degrees. More preferably, the angle may be between 110 and 130 degrees. The advantage of having an angle greater than 100 degrees in the bit head-shank transition area is that this kind of construction greatly reduces the stress encountered by the bit head-shank transition area during the drilling operation. Reduced stress preserves the strength of the rock drill bit ensuring that the rock drill bit has a longer than average lifespan. This reduces the maintenance cost for the drilling assembly as the rock drill bit does not have to be replaced frequently. Further, the down-time of the equipment is also reduced as now the bit is replaced fewer number of times.

Another advantage of this unique feature of the angle between the bit head and shank transition is that this kind of construction forms a conical surface in the bit to transmit the feed force. This conical surface presents the following advantages. It guides precisely the drill bit during operation and increases the contact surface for feed force transmission, thus reducing the surface pressure or stress in the bit head-shank transition area.

According to the second embodiment of the disclosure, the internal bore at the center of the bit is closed at the front end or the axially forward of the shank and open at the rear end towards the piston. The internal blind bore in this rock drill bit is configured to constitute a part of the bottom working chamber of the hammer. Since the center of the bit is not used for flushing as in conventional drill bits, this volume can be used as the working chamber for the hammer. An advantage of this kind of construction is that it would make the hammer more compact.

Optionally, the feature of the angle between bit head and shank being greater than 100 degrees, would improve the strength of the bits in which the internal bore at the center is closed at the front end of the shank and open at the rear end towards the piston. These blind-bore bits encounter immense stress in the bit head-shank transition area because of the presence of flushing holes in that area which create fluid passages for the upstream flow from the hammer. Having an angle greater than 100 degrees between the bit head and the shank in such blind-bore bits substantially improves the strength of the bit.

According to the third embodiment of the disclosure, in the rock drill bit, the bit head-shank transition area, near the flushing holes, is provided with a recess which is preferably in the form of an inward curvature or a concave groove. This structural feature provides the advantage of reduced stress in the bit head-shank transition are in the rock drill bit. Specifically, this structural feature improves the strength and lifespan of those rock drill bits in which the internal central bore is closed at the front end of the shank and open at the rear end towards the piston. Optionally, the recess can be in the shape of square, circular, elliptical, rectangular or triangular-pockets.

According to the fourth embodiment of the present disclosure, the radially outward facing region of the shank of the rock drill bit is provided with a plurality of splines which are configured to engage with the corresponding complimentary splines on the radially inward facing region of a driver sub which may be mounted over the rock drill bit in the hammer assembly. It is an advantage to have these complimentary splines on the shank and the sub to allow easy and efficient transfer of rotational drive from the drive sub to the rock drill bit.

Preferably, the bit head and the shank in the rock drill bit are constructed as a single integrated unit. However, the features explained above are also adapted to provide good drilling results if the rock drill bit constitutes of multiple components comprising the bit head and the shank assembled together.

Optionally, the rock drill bit described in the present disclosure is adapted to work with the reverse circulation percussive hammers.

Other aspects and advantages of the present disclosure will be more apparent from the following description, which is not intended to limit the scope of the present disclosure.

BRIEF DESCRIPTION OF THE DRAWINGS

Some embodiments of the invention will be explained in greater detail with reference to the accompanying drawings in which.

DETAILED DESCRIPTION OF THE DRAWINGS

The present disclosure will now be described with reference to the accompanying embodiments which do not limit the scope and ambit of the disclosure. The description provided is purely by way of example and illustration.

Figure 1:
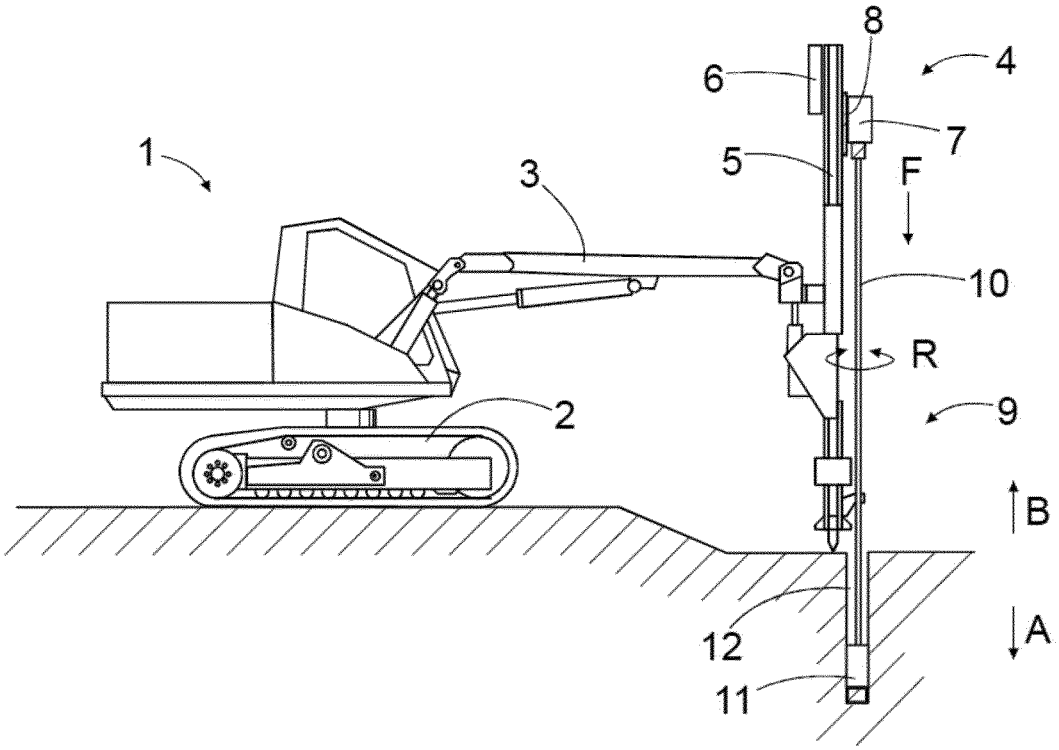
FIG. 1 shows schematically a rock drilling rig provided with a DTH rock drilling machine.

FIG. 1 shows a rock drilling rig 1 that comprises a movable carrier 2 provided with a drilling boom 3. The boom 3 is provided with a rock drilling unit 4 comprising a feed beam 5, a feed device 6 and a rotation unit 7. The rotation unit 7 may comprise a gear system and one or more rotating motors. The rotation unit 7 may be supported to a carriage 8 with which it is movably supported to the feed beam 5. The rotation unit 7 may be provided with drilling equipment 9 which may comprise one or more drilling tubes 10 connected to each other, and a DTH drilling machine 11 at an outermost end of the drilling equipment 9. The DTH drilling machine or hammer 11 is located in the drilled bore hole 12 during the drilling.

Figure 2:
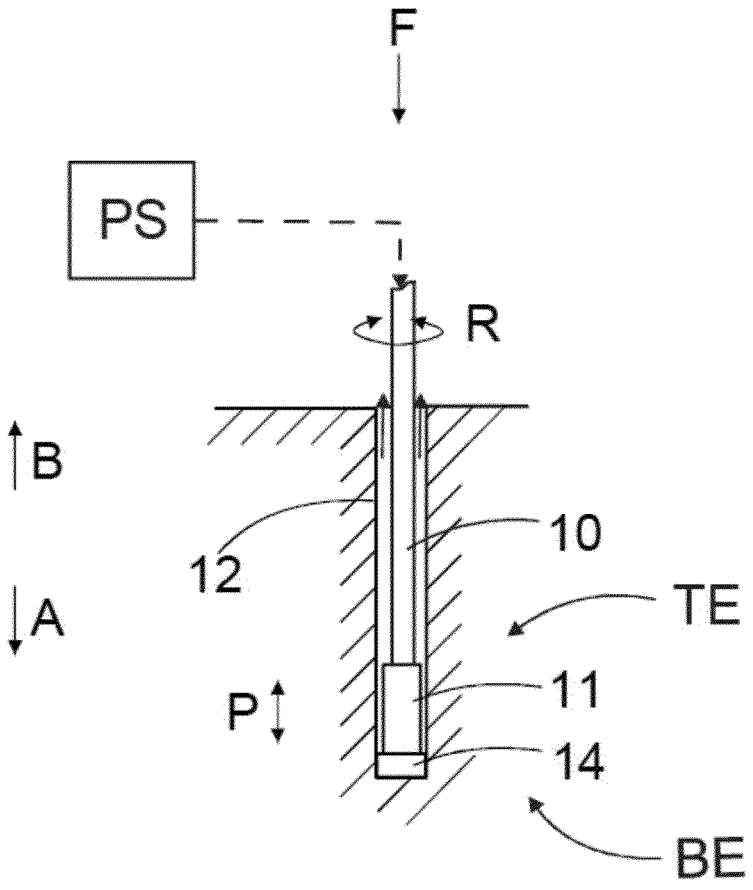
FIG. 2 shows schematically a DTH drilling machine at the bottom of a drill hole.
Figure 4:
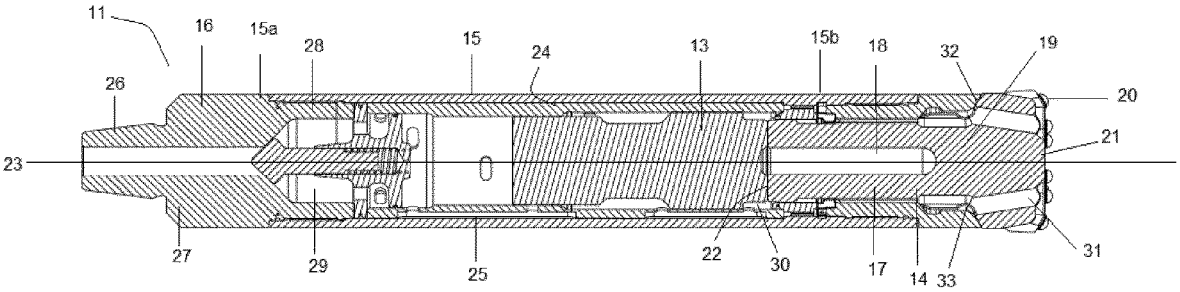
FIG. 4 shows vertical cross-sections of a whole hammer with an DTH bit according to a specific implementation of the present disclosure.

FIG. 2 and FIG. 4 show that the hammer 11 comprises an impact device or a piston 13 (shown in FIG. 4). The piston 13 is at the opposite end of the drilling equipment 9 in relation to the rotation unit 7. During drilling, a drill bit 14 is connected directly to the piston 13, whereby percussions P generated by the piston 13 are transmitted to the drill bit 14. The drilling equipment 9 is rotating around its longitudinal axis in direction R by means of the rotation unit 7 shown in FIG. 1 and, at the same, the rotation unit 7 and the drilling equipment 9 connected to it are fed with feed force F in the drilling direction A by means of the feed device 6. Then, the drill bit 14 breaks rock due to the effect of the rotation R, the feed force F and the percussion P. Pressurized fluid is fed from a pressure source PS to the drilling machine 11 through the drilling tubes 10. The pressurized fluid may be compressed air and the pressure 5 source PS may be a compressor.

As can be seen in FIG. 4, the pressurized fluid is directed to influence to working surfaces of the piston 13 and to cause the piston 13 to move in a reciprocating manner and to strike against impact surface or anvil 22 of the drill bit 14. After being utilized in working cycle of the hammer 11, pressurized air is allowed to discharge form the hammer 11 and to thereby provide flushing for the drill bit 14. Further, the discharged air pushes drilled rock material out of the drill hole 12 in an annular space between the drill hole and the drilling equipment 9. Alternatively, the drilling cuttings are removed from a drilling face inside a central inner tube passing through the impact device. This method is called reverse circulation drilling. FIG. 2 indicates by an arrow TE an upper end or top end or the axially rearward end of the hammer 11 and by an arrow BE a lower end or bottom end or axially forward end of the hammer 11.

Figure 3:
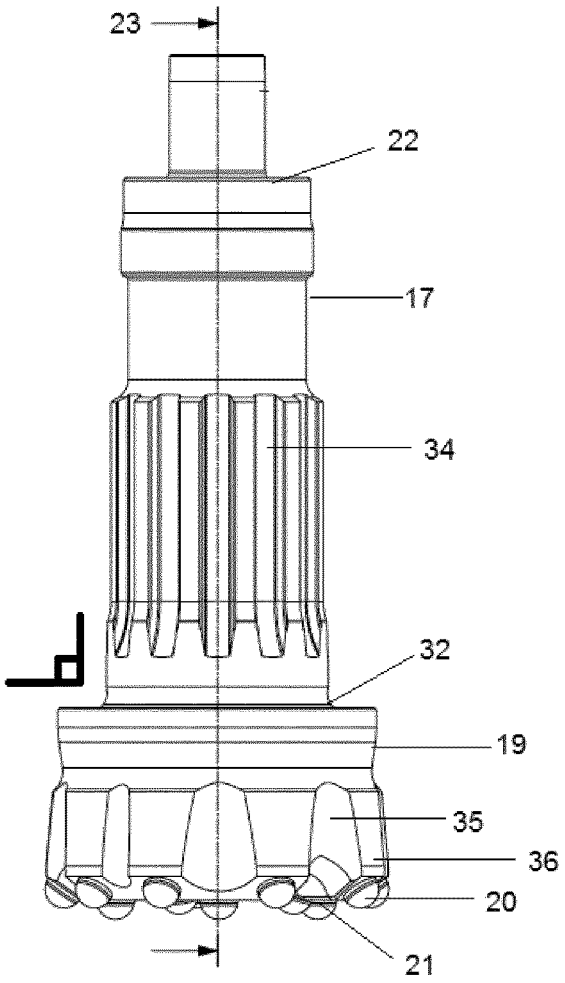
FIG. 3 shows a side view of a standard DTH drill bit.

Referring to FIG. 3, a projected view of a standard DTH rock drill bit 14 having a shank 17 and a bit head 19 is shown (prior-art), with 23 being the longitudinal axis, 21 being the cutting face or the forward face of the bit and 22 being the rearward face of the bit which received impact from the piston 13 (not shown). Cutting inserts as buttons 20 are provided on the forward face 21. Also visible in the figure, are a plurality of splines 34 projecting radially outwards extending along a portion of the shank 17. Drill bit head 19 also comprises of a plurality of peripheral sludge grooves 35 which are recessed radially into an annular outer wall 36 of the bit head 19. It can be observed from this figure that the bit head-shank transition area 32, which is the area at the junction of the bit bead 19 and the shank 17, for a standard DTH bit has an angle of 90 degrees. The bit head-shank transition is located where the feed force is transmitted from the hammer to the bit, in other words it is the feed force transmission contact surface. All features located below this point are part of the skirt design and these features do not interact directly with the hammer/driver sub. The stress caused in the area 32 during the drilling operation is high and is a cause for the reduced life span of the drill bit 14.

Figure 5:
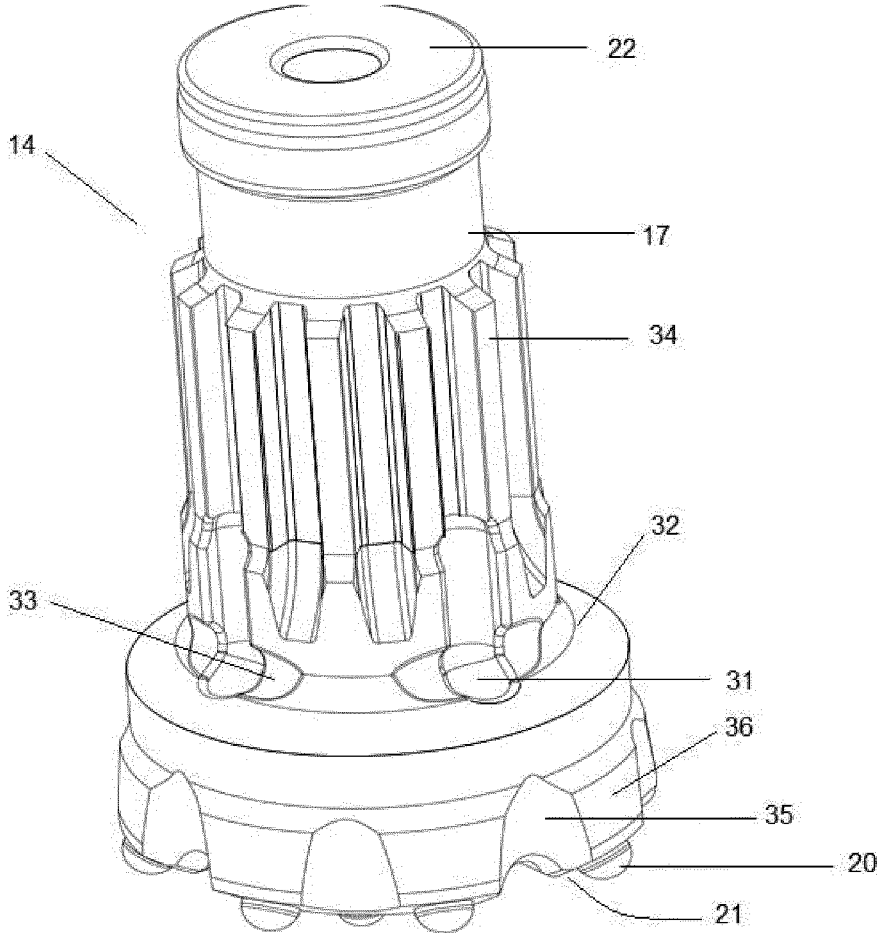
FIG. 5 shows a side view of the drill bit of FIG. 4.

According to the first embodiment of the present disclosure, the problem of high stress in the area 32 is proposed to be solved by providing a drill bit 14 which has a bit head-shank transition angle of greater than 100 degrees, shown as $\alpha$ in FIGS. 7*a*, 7*b*, 8, 10*a* and 10*b*. As can be seen in FIG. 4 and FIG. 5, the area 32 between the shank 17 and the bit head 19 sports an angle greater than 100 degrees. Preferably, this angle has a value greater than 120 and less than 160 degrees. More preferably, the angle is between 110 and 130 degrees. As can be seen in FIG. 5, the increased angle forms a conical surface in the bit head-shank transition area 32 which facilitates the accurate positioning of the drill bit 14 related to surrounding components like a drive sub and provides an increased contact area which in turn reduces the surface pressure.

Referring to FIG. 4, the vertical cross-section of the hammer 11 is shown. The hammer 11 comprises a casing 15 with an axially rearward end 15*a* and an axially forward end 15*b*. Within the casing 15 is mounted a conventional free piston 13 which is arranged to be moved in a reciprocating manner during its work cycle. A top sub 16 is at least partially accommodated within the rearward end 15*a* of the casing 15. Also mounted, is a connection piece 27 by means of which the hammer 11 is connected to the drilling tube 10. The connection piece 27 may comprise threaded connecting surfaces 26. In connection with the connection piece 27, is an inlet port 28 for feeding pressurized fluid to the piston. The inlet port 28 may comprise valves which allow the feeding of the fluid towards the piston but prevent the flow of the fluid in the opposite direction. At the axially rearward end or top end TE of the piston is a top working chamber 29 and at the axially forward end or the bottom end BE of the piston is the bottom working chamber 30. A distributor cylinder 25 extends axially within the casing 15 against the inner face 24 of the casing and defines an axially extending internal chamber which includes the top working chamber 29 and the bottom working chamber 30. Piston 13 is capable of reciprocating axially to shuttle within the chamber regions 29 and 30.

Figure 6:
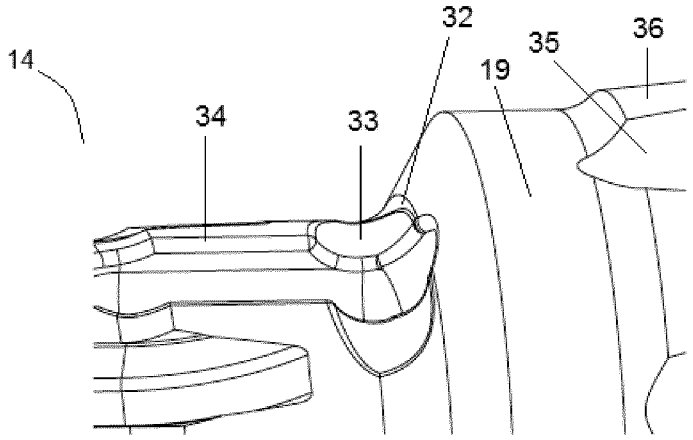
FIG. 6 shows the detailed perspective view of the drill bit according to one of the preferred embodiments of the present disclosure showing both the bit head-shank transition angle as being greater than 100 degrees and the recess as an inward curvature or a concave groove in the bit head-shank transition area of the drill bit.

The drill bit 14 as shown in FIG. 5, comprises a bit head 19 which is positioned at the axially forward end of the elongated shank 17. The shank 17 comprises axially extending splines 34 which are aligned parallel to longitudinal axis 23 of the drill bit 14. The axially rearward face 22 of the shaft 17 represents an anvil for receiving impacts from the piston 13 within the hammer 11 (not shown). The bit 14 also comprises a bit head-shank transition area 32 which according to a preferred embodiment of the present disclosure has an angle greater than 100 degrees. The bit head 19 and the shank 17 may be constructed as a single integrated unit. The bit head 19 comprises of a forward face 21 which is provided with a plurality of hardened cutting inserts or buttons 20 distributed all over the forward face 21. Both the rearward face 22 and the forward face 21 are perpendicular to the longitudinal axis 23 of the drill bit. The bit head 19 further comprises a plurality of flushing holes 31 which form passages for the pressurized fluid from the exhaust of the hammer 11 to enter the drill bit 14. As seen in FIGS. 5 and 6, there are also provided a plurality of sludge grooves 35 which are recessed radially into the annular outer wall 36 of the bit head 19. These grooves 35 also extend axially rearward from the forward face 21 to the bit head-shank transition area 32.

Figure 7A:
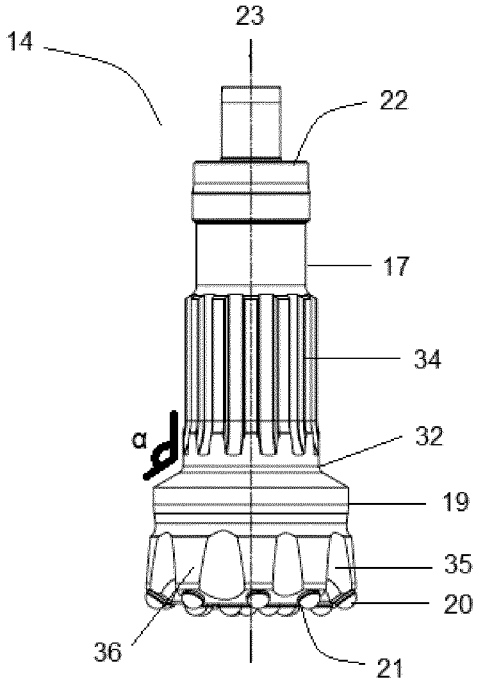
FIG. 7*a* and FIG. 7*b* shows an enlarged perspective view of the bit head-shank transition area of a drill bit according to one of the preferred embodiments of the present disclosure where the angle between the bit head and shank is greater than 100 degrees and the recess in the form of an inward curvature is also shown in the bit head-shank transition area.
Figure 7B:
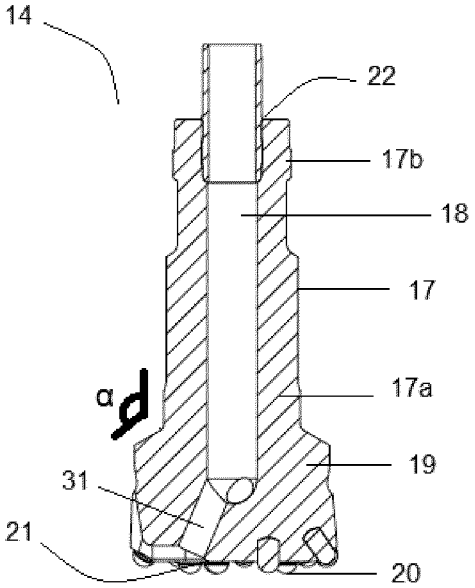

Referring to FIG. 6, the drill bit 14 is shown to have a plurality of splines 34 directed outwardly from the shank 17 and axially extending upward from the bit head-shank transition area 32. The splines 34 are configured to couple with complimentary splines on the drive sub (not shown) which is also a component of the hammer assembly 11. The complimentary splines on the drive sub are instrumental in transmitting the rotational torque to the splines 34 on the drill bit 14. As seen in FIG. 6 and FIGS. 7*a* and 7*b*, the drill bit 14 is provided with recesses 33 which are shown to be in the form of peripheral arcuate grooves in the bit head-shank transition area 32 near the openings 31 defining the flushing holes. According to a specific implementation, the recesses 33 are configured to reduce the stress encountered by the bit head-shank transition area 32 especially in the drill bits where the internal central bore 18 is closed at its axially forward end. The shape and the number of the recesses 33 may vary depending on the requirement of the equipment. The recesses 33 can be in the shape of square, circular, elliptical, rectangular or triangular pockets.

Figure 8:
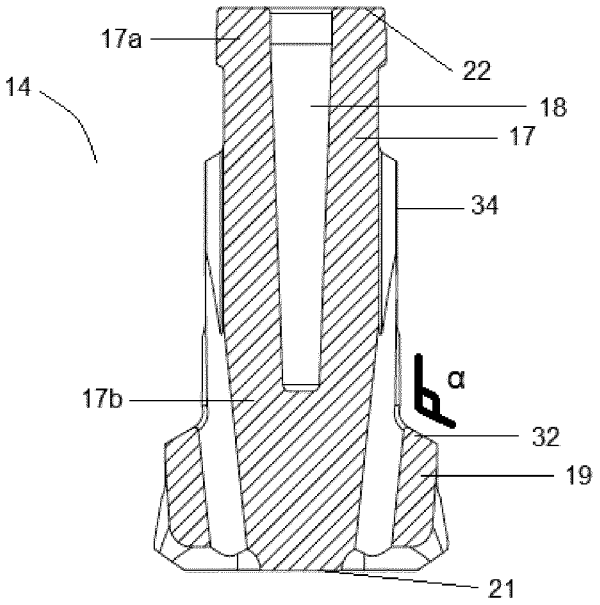
FIG. 8 shows the vertical cross-section of a drill bit with blind central bore according to one of the preferred embodiments of the present disclosure with the bit head-shank transition angle as being greater than 100 degrees.

According to a specific implementation of the present disclosure, as explained in the vertical section of the bit 14 shown in FIG. 8, the drill bit 14 comprises a internal bore 18 which is at the center of the bit 14, and is closed at the axially front end 17*a* of the shank 17 and open at the axially rear end 17*b* towards the piston 13. The internal bore 18 is configured to form a part of the bottom working chamber 30. The increased angle at the bit head-shank transition area 32 can be observed in this figure.

Figure 9:
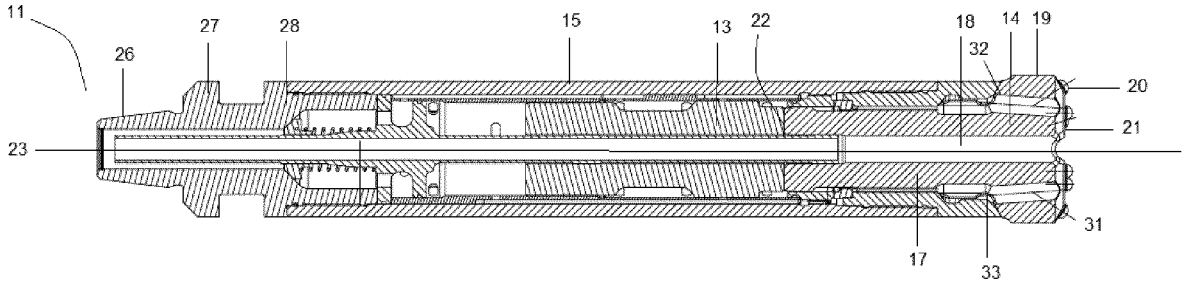
FIG. 9 is a vertical cross-section of the reverse circulation hammer assemblies according to one of the preferred embodiments of the present disclosure.

Referring to FIG. 9, the vertical cross-section of reverse-circulation hammer (RC hammer) is shown according to one of the preferred embodiments of the present disclosure. The RC hammer 11 comprises a casing 15 within which is enclosed a piston 13 which impacts the drill bit 14 on its rearward facing surface representing the anvil 22 resulting into reciprocative drilling motion. The drill bit 14 comprises on its forward face 21, cutting buttons or inserts 20 which cut through the drilling surface. The drill bit 14 is also provided with a central internal bore 18, the forward end of which opens into the forward face 21 of the drill bit 14. The bit head-shank transition area 32 has an angle which is greater than 100 degrees. Also present in the bit head-shank transition area 32 are the arcuate concave grooves or recesses 33 which are present to reduce the stress encountered in the region 32 during the drilling operation.

Figure 10A:
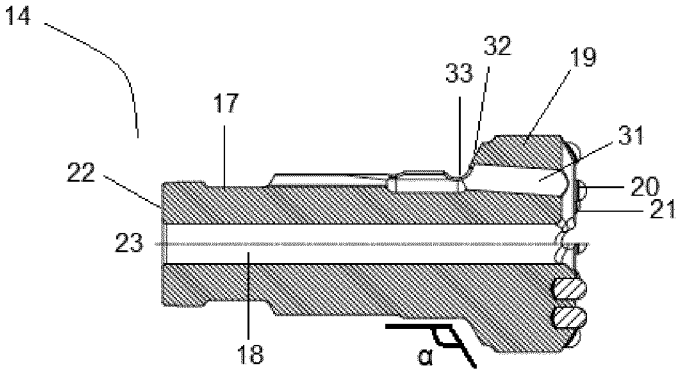
FIG. 10*a* and FIG. 10*b* show the vertical cross-sections for the drill bit used in reverse circulation hammer according to specific embodiments of the present disclosure.
Figure 10B:
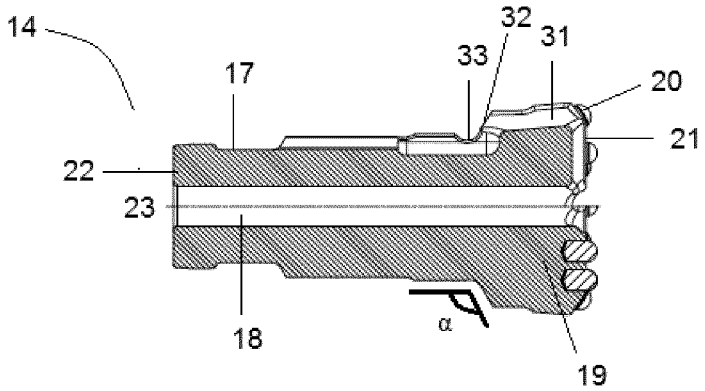

FIGS. 10*a* and 10*b* describe the vertical cross-sections of a drill bit 14 when used in a reverse circulation hammer 11. It can be observed in the FIG. 10*a*, that the drill bit 14 is provided with a central internal bore 18 through which the pressurized fluid along with cuttings or drilled material flows upstream. Also provided in the bit 14 are flushing holes 31, shank 17 and bit head 19 with buttons 20 on the forward face 21. The flushing holes 31 are positioned between the centre and the periphery of the bit head 19, extending axially rearward from the forward face 21 to the bit head-shank transition area 32 creating passages for fluid to flow from the hammer 11. The bit-head transition area 32 has an angle greater than 100 degrees and is provided with recess 33.

Referring to FIG. 10*b*, a drill bit 14 for use in reverse-circulation hammer is shown. The bit 14 has a central internal bore 18 for the passage of pressurized fluid with drilled material. The flushing holes 31 are positioned along the periphery of the bit head 19, and the flushing holes 31 extend axially rearward from the forward face 21 of the bit to the bit head-shank transition area 32 creating passages for fluid to flow from hammer 11. Also provided in the bit 14 are shank 17, and bit head 19 with buttons 20 on the forward face 21. The bit-head transition area 32 has an angle greater than 100 degrees and is provided with recess 33.

The invention claimed is:

1. A rock drill bit for a percussive drilling hammer positioned at a cutting end of the hammer, the rock drill bit comprising:

a head;

an elongated shank connected to the head at a front end of the rock drill bit;

a head-shank transition area located where the head connects to the shank, wherein the head-shank transition area is located where a feed force is transmitted from the hammer to the bit and forms a feed force transmission contact surface;

an anvil disposed at a rear end of the shank arranged for receiving an impact of the piston;

a plurality of buttons provided at a front face of the head configured to engage the material to be crushed in an intended direction of drilling; and a plurality of flushing passages extending through the head from the front face of the head to the head-shank transition area and having at least one opening at the front face of the head and the head-shank transition area, wherein an angle formed between the head and the shank at the feed force transmission contact surface is greater than 100 degrees and wherein the feed force transmission contact surface receives a feed force from a surrounding bit sub of the hammer, the bit sub having an angle that matches the angle of the feed force transmission contact surface.

2. The rock drill bit as claimed in claim 1, wherein the angle formed between the head and the shank at the head-shank transition area is greater than 100 degrees and smaller than 160 degrees.

3. The rock drill bit as claimed in claim 1, wherein the angle formed between the head and the shank at the head-shank transition area of the drill bit is greater than 110 degrees and smaller than 130 degrees.

4. The rock drill bit as claimed in claim 1, wherein a surface of the head-shank transition area has a recess which is positioned proximally to the openings of the flushing passages at the head-shank transition area.

5. The rock drill bit as claimed in claim 4, wherein the recess is in the form of an arcuate concave groove extending peripherally in the bit head-shank transition area.

6. The rock drill bit as claimed in claim 1, wherein the bit head and the shank are constructed as a single integrated unit.

7. The rock drill bit as claimed in claim 1, further comprising an internal bore at a center of the bit, the internal bore being closed at the front end of the shank and open at the rear end towards the piston and wherein the internal bore is configured to constitute a part of a bottom working chamber of the rock drill bit.

8. The rock drill bit as claimed in claim 1, wherein the shank includes a plurality of axially extending splines, which are configured to engage with a plurality of complimentary splines on a component surrounding the shank for transferring the torque from the surrounding component to the rock drill bit.

9. The rock drill bit as claimed in claim 1, wherein the rock drill bit is arranged to be used for a reverse circulation percussive hammer in such a way that drilling cuttings flow upstream and pass through the central bore.

10. The rock drill bit for reverse circulation percussive hammer as claimed in claim 9, wherein the reverse circulation drill bit includes a bit head having the plurality of flushing openings positioned between a center and a periphery of the head and extending from the forward face of the bit to the bit head-shank transition area creating passages for the fluid from the exhaust of the hammer.

11. The rock drill bit for reverse circulation percussive hammer as claimed in claim 9, wherein the reverse circulation drill bit comprises a bit head having a plurality of radially spaced flushing holes positioned at the periphery of the bit head extending from the front face of the bit to the bit head-shank transition area creating passages for the fluid from exhaust of the hammer.

* * * * *